US005797331A

United States Patent [19]

Watt

[11] Patent Number: 5,797,331

[45] Date of Patent: Aug. 25, 1998

[54] COUNTERBALANCED TABLE MECHANISM

[75] Inventor: Richard L. Watt, Jamestown, N.Y.

[73] Assignee: Weber Knapp Company, Jamestown, N.Y.

[21] Appl. No.: 827,306

[22] Filed: Mar. 28, 1997

[51] Int. Cl.[6] ..... A47B 9/00

[52] U.S. Cl. ..... 108/146; 108/147

[58] Field of Search ..... 108/144, 146, 108/147, 2; 248/162.1

[56] References Cited

U.S. PATENT DOCUMENTS

| | | | |
|---|---|---|---|
| 2,604,996 | 7/1952 | Smith | 108/147 |
| 2,672,386 | 3/1954 | Segal et al. | 108/147 |
| 3,213,809 | 10/1965 | Kritske | 108/146 |
| 3,710,735 | 1/1973 | Litvinoff et al. | 108/146 |
| 4,130,069 | 12/1978 | Evans et al. | 108/136 |
| 4,360,180 | 11/1982 | Bruneau | 248/162.1 |
| 4,559,879 | 12/1985 | Häusser | 108/136 |
| 4,981,085 | 1/1991 | Watt | 108/147 |
| 5,181,620 | 1/1993 | Watt | 211/59.3 |

*Primary Examiner*—Peter M. Cuomo
*Assistant Examiner*—Gerald A. Anderson
*Attorney, Agent, or Firm*—Bean, Kauffman & Snyder

[57] ABSTRACT

A mechanism for use in controlling vertical movement of a surface, such as a table top, supported for movement between upper and lower vertical positions, including a counterbalance mechanism for counterbalancing at least part of the weight of the surface and/or a weight placed thereon, and a brake mechanism for releasably retaining the surface in a selected vertical position. The counterbalance mechanism includes a member having a first end supported for pivotal movement about a first axis and a spring tending to opposed pivotal movement of the member in a direction corresponding to lowering movement of the surface; and the brake mechanism includes a brake rod having one end supported for pivotal movement about a second axis disposed parallel to the first axis and a brake rod clamping mechanism supported by the member for pivotal movement about a third axis disposed parallel to the first axis and supported by the brake rod for movement lengthwise thereof with the clamping mechanism normally clamping against the brake rod to prevent pivot movement of the member in the direction corresponding to lowering movement of the surface, and an operator for manually releasing the clamping mechanism from clamping engagement with the brake rod.

10 Claims, 8 Drawing Sheets

FIG. 1
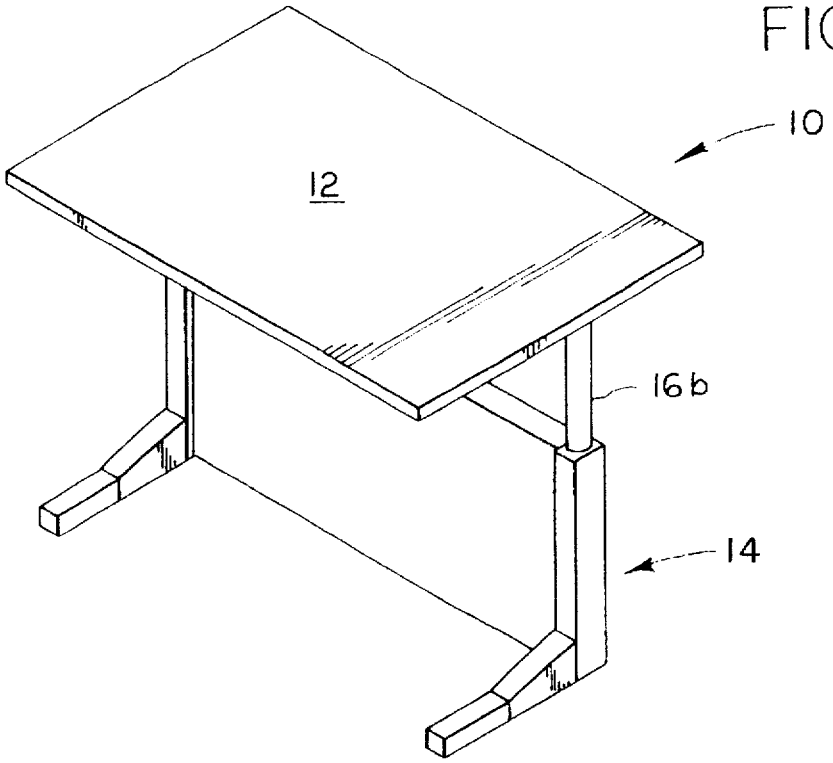
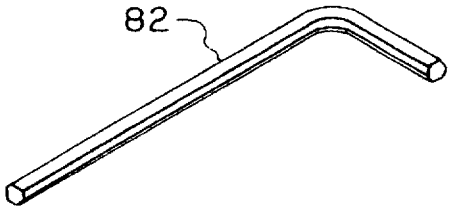
FIG. 13
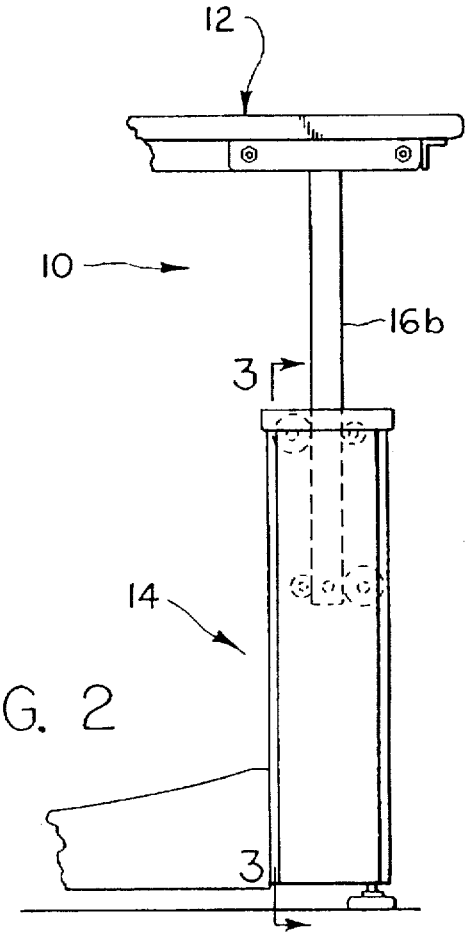
FIG. 2

COUNTERBALANCED TABLE MECHANISM

BACKGROUND OF THE INVENTION

It is known to provide a mechanism for controlling vertical movement of a surface, such as a desk or table top or a shelf, relative to a supporting base wherein a counterbalance mechanism is provided to balance at least a part of the weight of the surface and/or weight supported thereon and a brake mechanism is provided to releasably retain the surface in a desired vertical position. Prior patents disclosing this general type of mechanism include U.S. Pat. Nos. 4,130,069; 4,360,180; 4,559,879; 4,981,085 and 5,181,620.

Moreover, in U.S. Pat. Nos. 4,981,085 and 5,181,620, a counterbalance mechanism employs a pivotally supported member coupled via cables to the surface to be supported for vertical movement and a spring for controlling pivotal movement of the member.

SUMMARY OF THE INVENTION

The present invention relates to mechanisms for controlling vertical movements of a surface, such as defined by a desk or table top or a shelf, and broadly includes a counterbalance mechanism for at least partially counterbalancing the weight of the surface and/or weight supported thereon and a brake mechanism for releasably retaining the surface in a desired vertical position.

In accordance with a preferred form of the invention, the counterbalance mechanism includes a member having an end supported for pivotal movement about a first axis and a second end coupled to the surface; and a spring coupled to the member for opposing lowering movements of the surface. The brake mechanism includes a brake rod supported adjacent one end thereof for pivotal movement about a second axis disposed parallel to the first axis; a clamping mechanism supported by the member for pivotal movement about a third axis disposed parallel to the first axis and by the brake rod for movement lengthwise thereof; and a manual control for selectively releasing the clamping mechanism from clamping engagement with the brake rod.

The spring is adjustably connected to the member by a rack and gear assembly, which provides for selective adjustment of the moment arm through which spring force acts on the member about the first axis. The assembly includes a rack, which is carried by the member and formed with teeth extending along one edge thereof; a pair of gears having their teeth arranged to engage with each other and the teeth of the rack; and pairs of links having first ends connected one to each of the gears for rotation about parallel axes and second ends connected to the spring for pivotal movement about a common pivot axis arranged parallel to the axes and the first axis. The common axis and the axes straddle the rack, and the spring tends to bias the gears into engagement with each other and the rack. The gears may be released from locking engagement with each other and the rack by rotations individually imparted thereto by a manually operable tool fitted into a recess formed in each gear.

BRIEF DESCRIPTION OF THE DRAWINGS

The nature and mode of operation of the present invention will now be more fully described in the following detailed description taken with the accompanying drawings wherein:

FIG. 1 a prospective view of a table having a horizontally disposed surface or table top whose vertical movement is subject to control by the mechanism of the present invention;

FIG. 2 is a fragmentary side elevation of the table of FIG. 1;

FIG. 13 is a prospective view of a tool adapted for use in adjustment of the rack and gear assembly.

DETAILED DESCRIPTION

Figure 3:
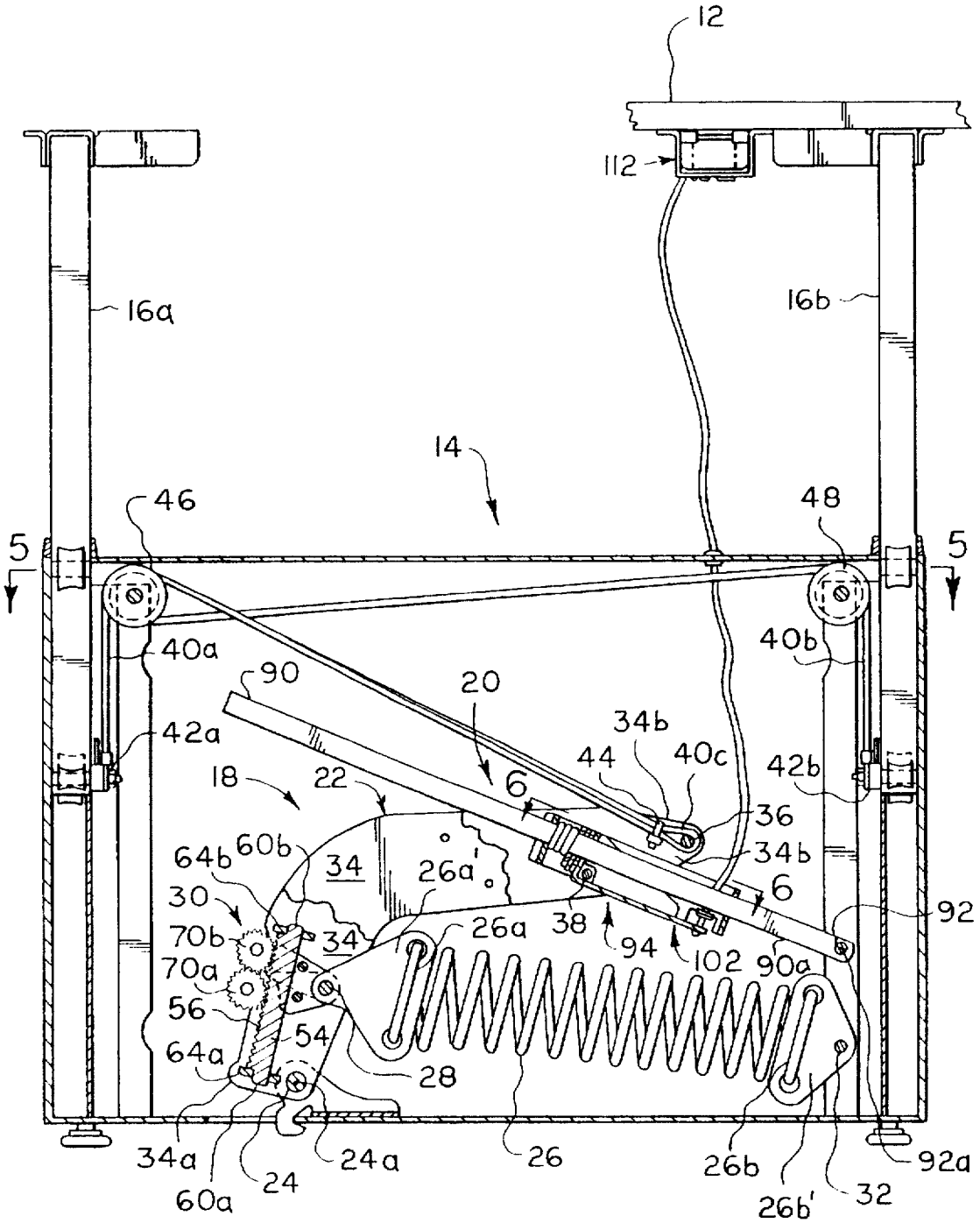
FIG. 3 is a sectional view taken generally along the line 3—3 in FIG. 2 showing the mechanism when the surface is disposed in its uppermost position shown in FIG. 1.
Figure 4:
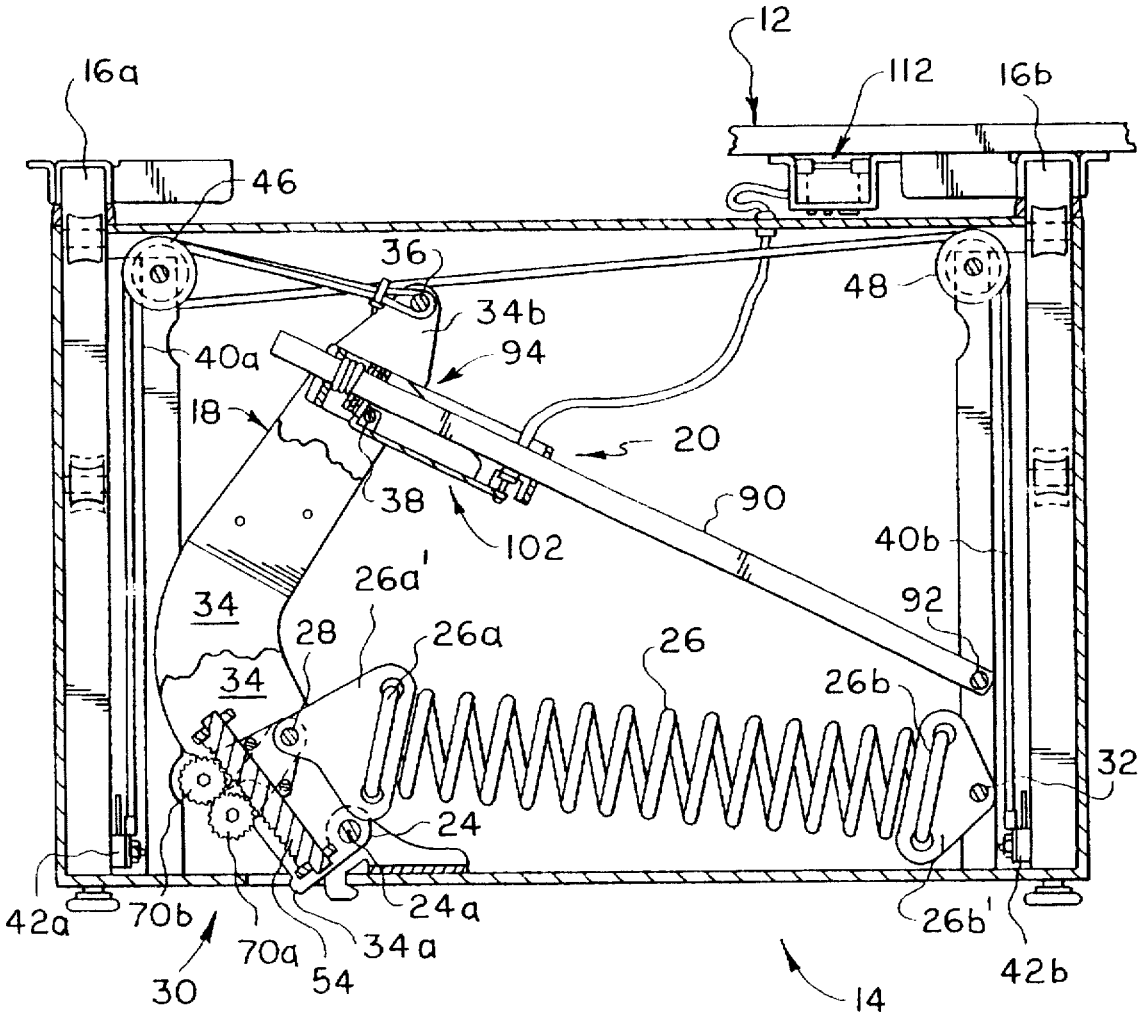
FIG. 4 is similar to FIG. 3, but showing the mechanism when the surface is in its lowermost position.
Figure 5:
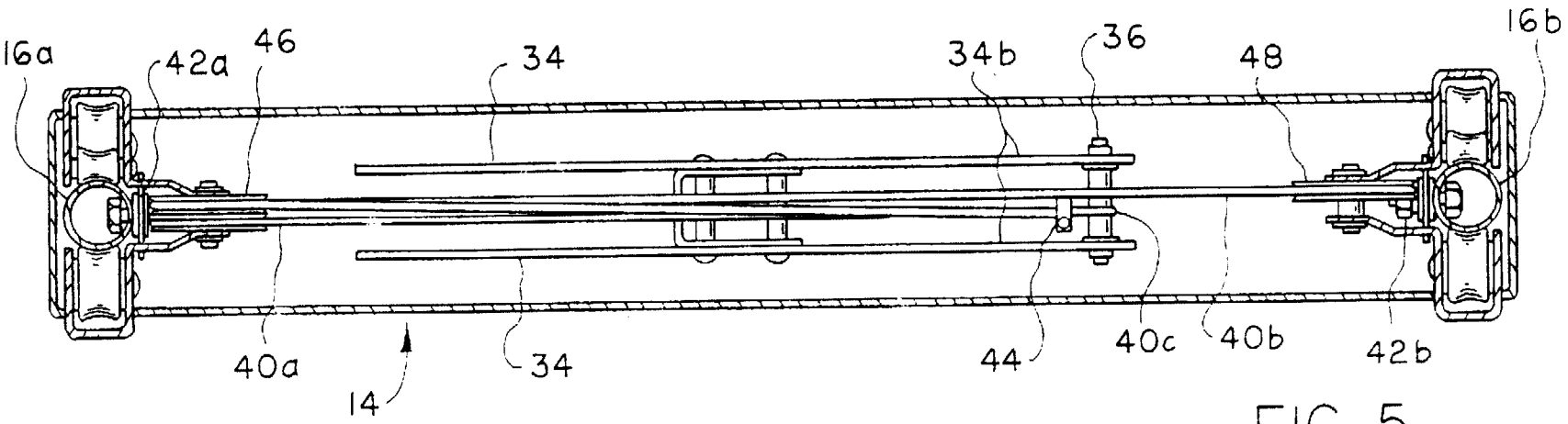
FIG. 5 is a sectional view taken generally along the line 5—5 in FIG. 3, but with the brake mechanism and the counterbalance biasing mechanism removed for purposes of clarity.

Reference is first made to FIGS. 1–4, wherein a table is generally designated as 10 and shown as having a work supporting surface or table top 12 supported for vertical movement relative to a base 14 between an upper or raised position shown in FIGS. 1–3 and a lower position shown in FIG. 4 by a pair of columns **16*a* and 16*b*, which are suitably guided by the base for vertical reciprocating movement under the control of a counterbalance mechanism 18 and brake mechanism 20**.

Counterbalance mechanism 18 is generally shown in FIGS. 3 and 4 as including a member 22 coupled to base 14 by a pivot pin 24 for pivotal movement about a horizontally disposed first axis **24*a* and biasing means, such as may be defined by a coil type counterbalance spring 26 having a first end 26*a* adjustably connected to member 22 via connector plates 26*a*', pivot pin 28 and a rack and gear assembly 30, and a second end 26*b* connected to base 14 via connector plates 26*b*' and pivot pin 32. Member 22 is preferably defined by a pair of parallel plates 34 and 34 having first ends 34*a* and 34*a* formed with aligned bore openings for receiving pivot pin 24, and second ends 34*b* and 34*b* formed with aligned openings for receiving a connector pin 36, and a second pair of aligned openings for receiving a pivot pin 38 serving to pivotally connect the member to brake mechanism 20**.

Member 22 is coupled to columns **16*a* and 16*b* via an endless flexible cable having first and second ends 40*a* and 40*b* fixed to the lower ends of columns 16*a* and 16*b* by connectors 42*a* and 42*b*, respectively, and a mid-portion 40*c* passed over connector pin 36 with the leads thereof being clamped together by a fitting 44. Cable first end 40*a* is trained over a first double pulley 46 in passing from connector 42*a* to mid-portion 40*c*, and cable second end 40*b* is trained successively over a second pulley 48 and first pulley 46 in passing from connector 42*b* to mid-portion 40*c*. With this arrangement, surface 12 moves upwardly from its lowermost position illustrated in FIG. 4 into its uppermost position illustrated in FIG. 3 incident to clockwise directed pivotal movement of member 22, as viewed in FIG. 4, and conversely moves downwardly from its uppermost position to its lowermost position incident counterclockwise directed pivotal movement of the member, as viewed in FIG. 3. Thus, the bias of spring 26 acting on member 22 about first axis 24***a* tends to oppose movement of surface 12 from its upper position of FIG. 3 towards its lower position of FIG. 4, such that at least a part of the weight of the surface and/or a separate weight supported thereon is counterbalanced.

Rack and gear assembly 30 is shown in FIGS. 3, 4, and 8–12 as including an elongated rack 54, which has a first edge defining gear teeth 56, a generally parallel second edge 58 and opposite mounting ends 60*a* and 60*b*, which are sized to be slidably received within through slot openings 62*a* and 62*b* of mounting plates 64*a* and 64*b*. Mounting plates 64*a* and 64*b* are in turn formed with ears 66*a* and 66*b* adapted for insertion into through slot openings 68*a* and 68*b* of plates 34 and 34, whereby to fix rack 54 for movement with member 22. Assembly 30 also includes a pair of gears 70*a* and 70*b* having teeth 72*a* and 72*b* sized and arranged to removably engage with each other, as well as teeth 56 of rack 54; first link means defined by a first pair of links 74*a* and 74*b*; and second link means defined by a second pair of links 76*a* and 76*b*. First ends of links 74*a* and 74*b* are connected to gear 70*a* for relative rotation about an axis 78*a*, and first ends of links 76*a* and 76*b* are connected to gear 70*b* for relative rotation about an axis 78*b*. Second ends of links 74*a*,74*b* and 76*a* and 76*b* are pivotally connected to the common pivot pin 28 for rotation about a common axis 28*a*, which is intended to be arranged essentially parallel to axes 78*a* and 78*b*, as well as first axis 24*a*. Gears 70*a* and 70*b* are formed with hexagonal openings 80*a* and 80*b* sized to removably receive an allen wrench 82 shown in FIG. 13 for adjustment purposes.

First pair of links 74*a* and 74*b* are interconnected by a first motion limiting pin 84*a* whose opposite ends are rigidly fixed to such links and whose mid-portion is arranged to loosely pass through a clearance opening 86*b* defined by link 76*b*. Similarly, second pair of links 76*a* and 76*b* are interconnected by a second motion limiting pin 84*b* whose opposite ends are rigidly fixed to such links and whose mid-portion is arranged to loosely pass through a clearance opening 86*a* defined by link 74*a*.

Again referring to FIGS. 3, 4, 9 and 10, it will be understood that axes 78*a*, 78*b* and first axis 24*a* straddle rack 54, and that spring 26 tends to move common axis 28*a* transversely outwardly away from second edge 58 of the rack, thereby to normally bias gear teeth 72*a* and 72*b* into engagement with each other and with rack teeth 56 in order to releasably lock pivot pin 28 against movement or displacement in a direction extending lengthwise of the rack. It will also be understood that motion limiting pins 84*a* and 84*b* are arranged for engagement with rack second edge 58 under certain operating conditions to be described.

Specifically, pins 84*a* and 84*b* are disengaged from rack surface 58, whenever the direction of action or force of spring 26 acting through axis 28*a* lies within an envelope defined by having the spring force lines $F_1$ and $F_2$ intersect with a plane P passing through axes 78*a* and 78*b* with the points of intersection being intermediate such axes. Outside of this envelope, pins 84*a* and 84*b* are adapted for engagement with edge 58.

As indicated above, the position of pivot pin 28 lengthwise of rack 54 is normally fixed, due to the cooperative engagement of gear teeth 72*a* and 72*b* with each other and with rack teeth 56 under the bias of spring 26. Pin 28 may, however, be adjustably moved between the first and second end positions generally shown in FIGS. 3 and 4, and FIG. 9 by rotations of gears 70*a* and 70*b* under the control of wrench 82 for purposes of selectively adjusting the moment arm through which spring acts on member 22 about pivot axis 24*a*. In this respect, the spring moment arm may be shortened from the first position shown in FIGS. 3 and 4, by inserting wrench 82 into hexagonal opening 80*a* of gear 70*a* and then operating the wrench to effect counterclockwise rotations of such gear until desired shortening of the spring moment arm is achieved. As an incident to counterclockwise rotation of gear 70*a*, its teeth engage with rack teeth 56 to effect movement of the gear along the rack relatively towards mounting end 60*a* and ratchet relative to teeth 72*b* of gear 70*b*, which is caused to follow gear 70*a* along rack 54. Specifically, counterclockwise movement of gear 70*a* initially forces gear 70*b* to rotate in a clockwise sense and move upwardly along rack 54, whereby the distance between axes 78*a* and 78*b* is increased against the force of spring 26 sufficiently to allow the crests of engaged ones of teeth 72*b* to slide over the crests of engaged ones of teeth 72*a*, whereupon gear teeth 72*b* and rack teeth 56 cooperate under the bias of spring 26 to effect momentary counterclockwise rotation of gear 70*b* until its teeth are once again fully engaged with the teeth of gear 70*a*. This ratcheting of gear 70*b* continues until counterclockwise rotation of gear 70*a* ceases. Conversely, the spring moment arm may be increased from the second position shown in FIG. 9 by inserting wrench 82 into hexagonal opening 80*b* of gear 70*b* and then operating the wrench to effect clockwise rotations of such gear. In this case, teeth 72*b* engage with rack teeth 56 to effect movement of gear upwardly along the rack relatively towards mounting end 60*b*, and during such movement teeth 72*b* engage with teeth 72*a* of gear 70*a* to effect ratcheting thereof, so as to permit gear 70*a* to follow gear 70*b*.

When the above adjustments of the spring moment arm are made, while spring force acts within the envelope described above, the relationship of parts is such that spring 26 is effective in maintaining the teeth of the ratcheting or following one of gears 70*a* and 70*b* in locking engagement with rack teeth 56. For adjustments made outside of such envelope, engagement of one or the other of pins 84*a* and 84*b* with rack edge 58 occurs, so as to prevent movement of the ratcheting or following one of gears 70*a* and 70*b* away from rack 54 sufficiently to disengage its teeth from rack teeth 56, such as would otherwise free the gears for uncontrolled movement lengthwise of the rack. Preferably, adjustments of the spring moment arm would be made in a preselected position, such as when member 22 is pivoted into a suitably defined position at or adjacent the uppermost position of surface 12 shown in FIG. 3.

Brake mechanism 20 is shown in FIGS. 3, 4, 6 and 7 as including a brake rod 90 having a first end 90*a* supported on base 14 by a pivot pin 92 for pivotal movement about a second axis 92*a* disposed parallel to first axis 24*a* and a brake rod clamping means 94 releasably engageable with the brake rod for movement lengthwise thereof and supported by member 22 via pivot pin 38 for relative pivotal movement about third axis 38*a* disposed parallel to axes 24*a* and 92*a*.

Figure 6:
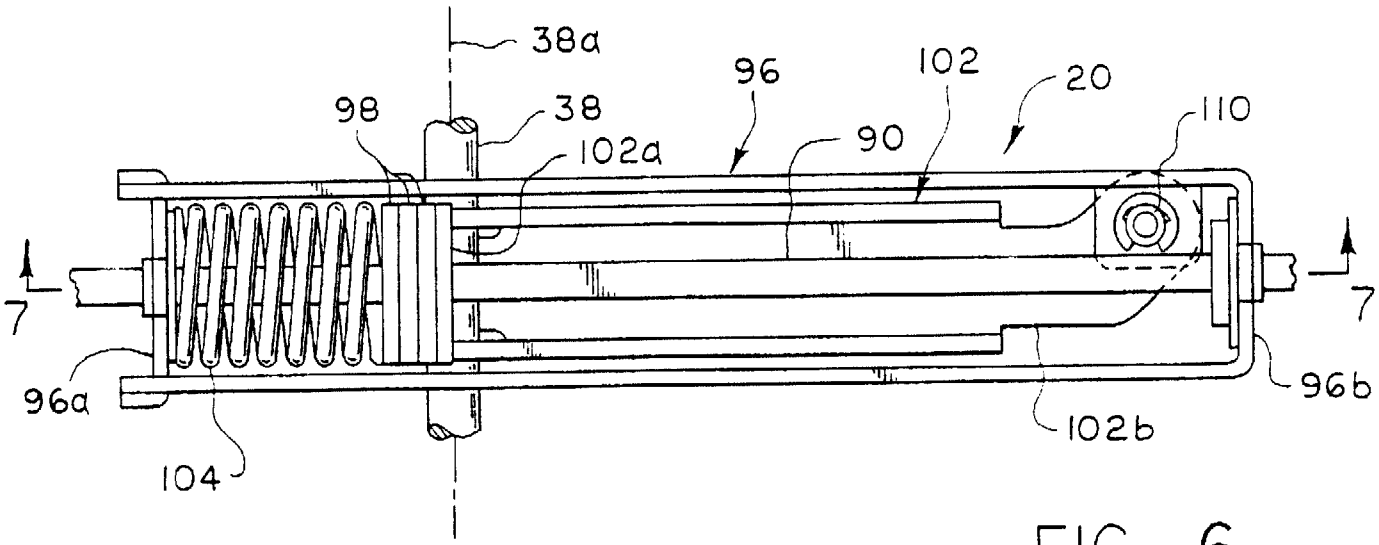
FIG. 6 is a sectional view taken generally along the line 6—6 in FIG. 3.
Figure 7:
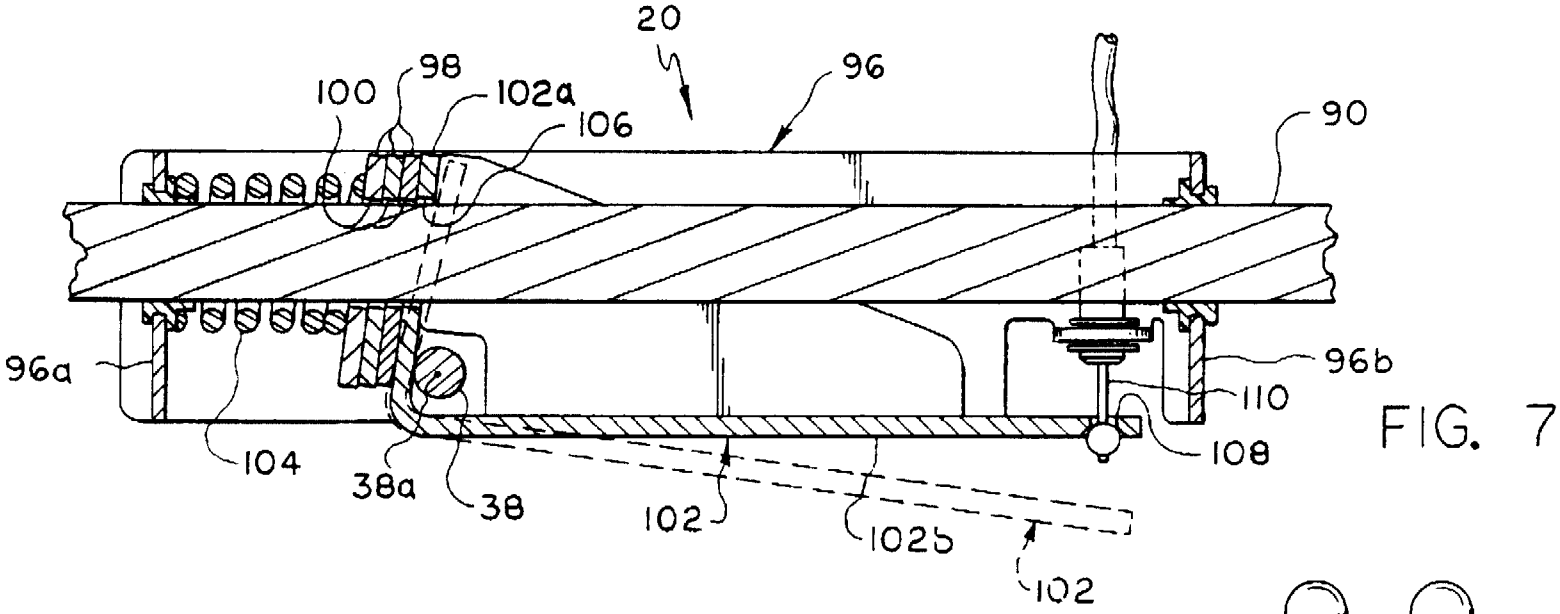
FIG. 7 is a sectional view taken generally along the line 7—7 in FIG. 6.
Figure 10:
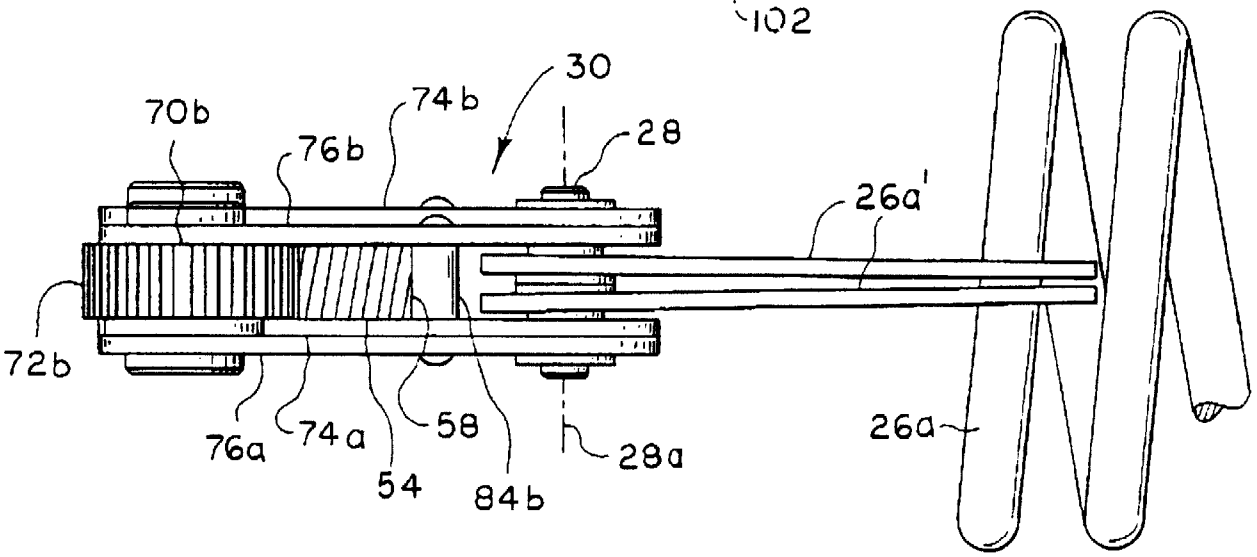
FIG. 10 is a sectional view taken generally along the line 10—10 in FIG. 9.
Figure 8:
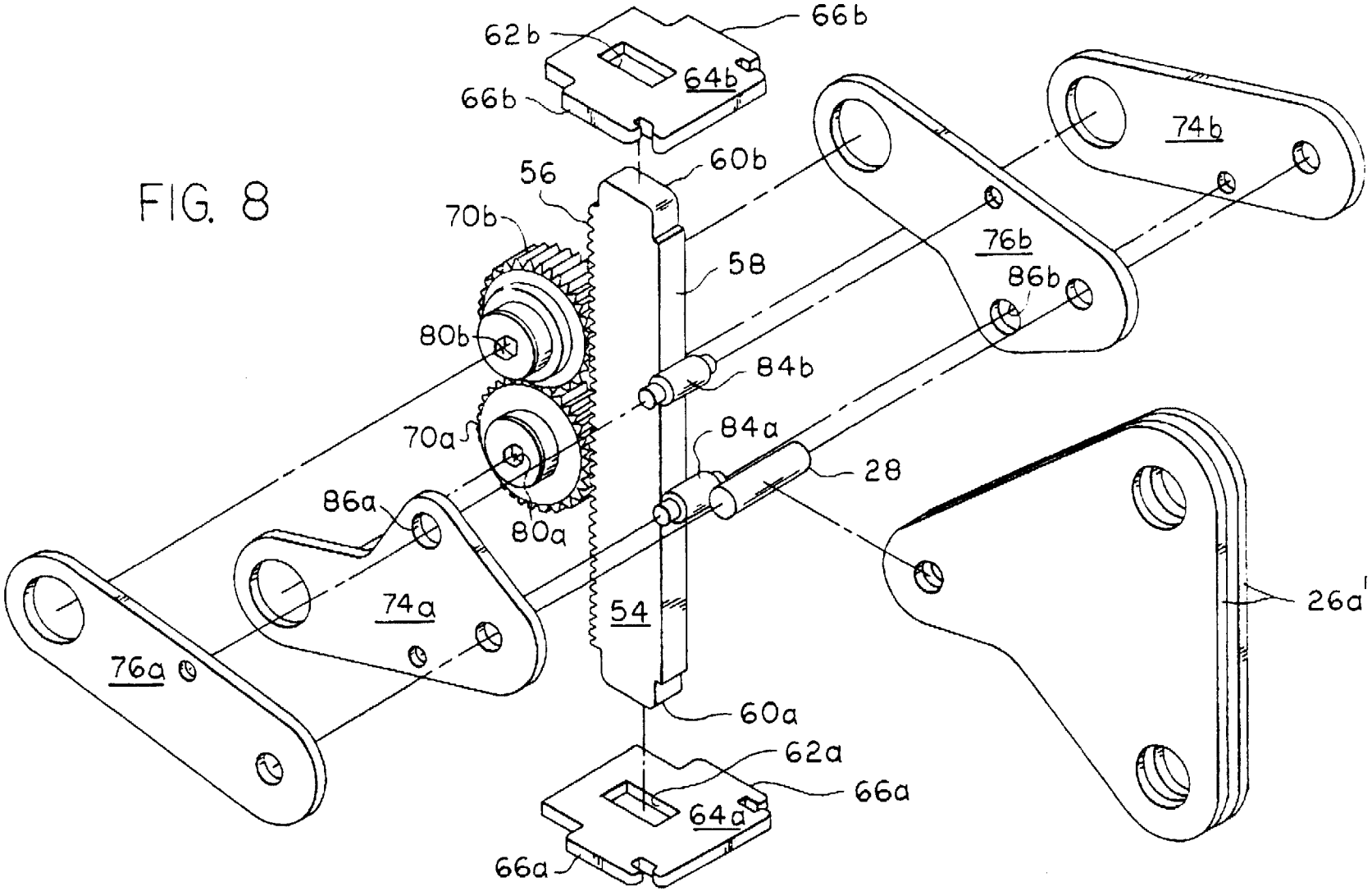
FIG. 8 is an enlarged, exploded, prospective view of a rack and gear assembly.
Figure 9:
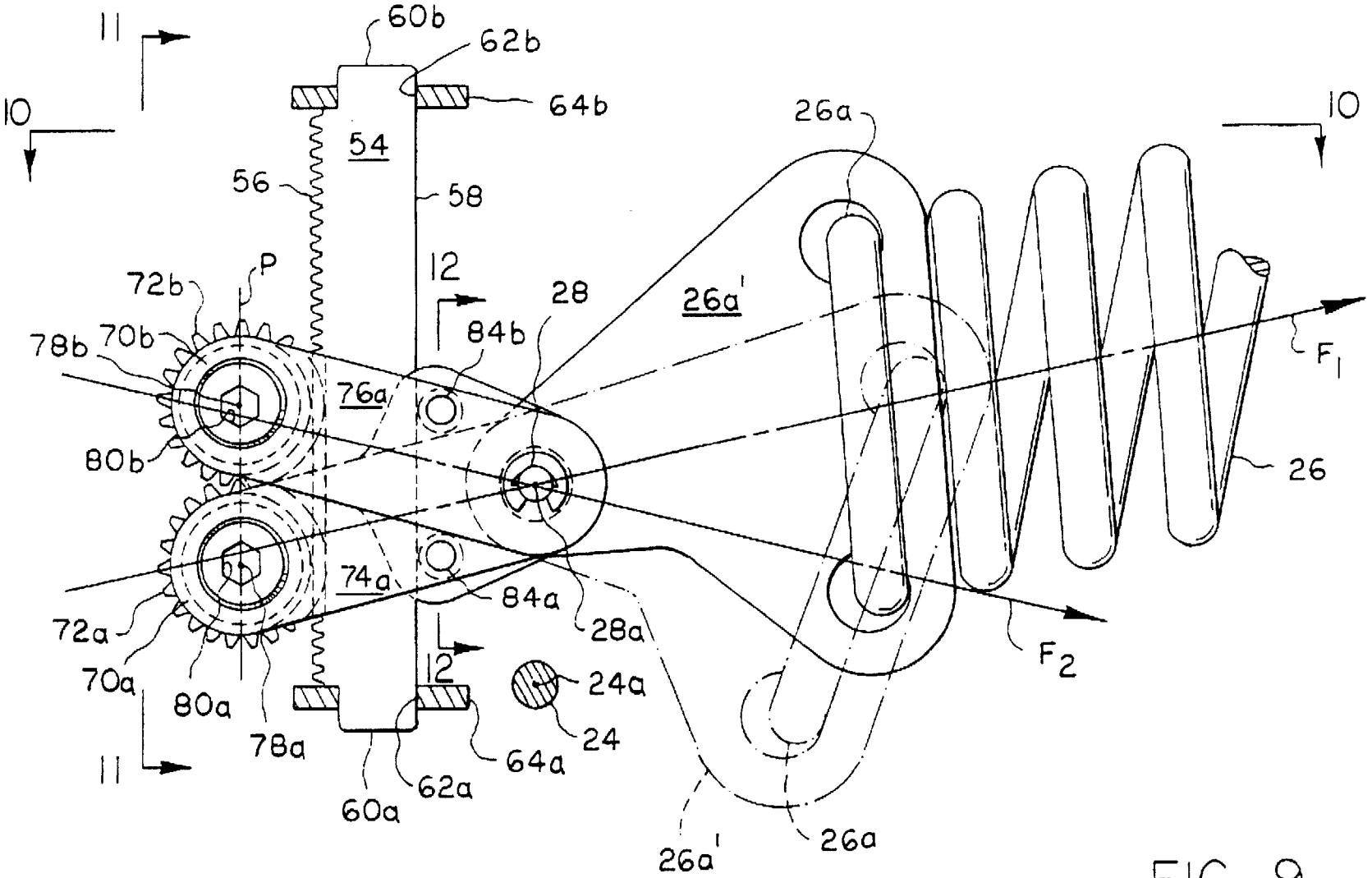
FIG. 9 is a side elevational view of the rack and gear assembly.
Figure 11:
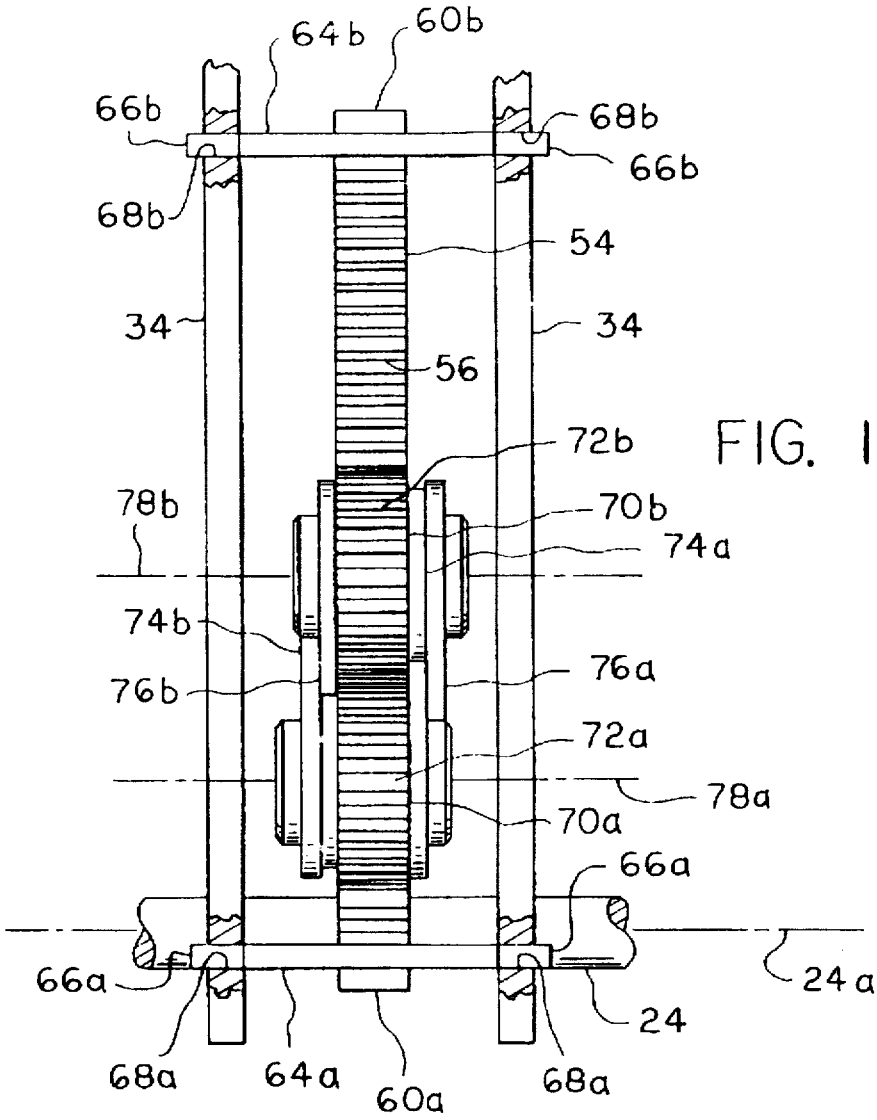
FIG. 11 is a sectional view taken generally along the line 11—11 in FIG. 9.
Figure 12:
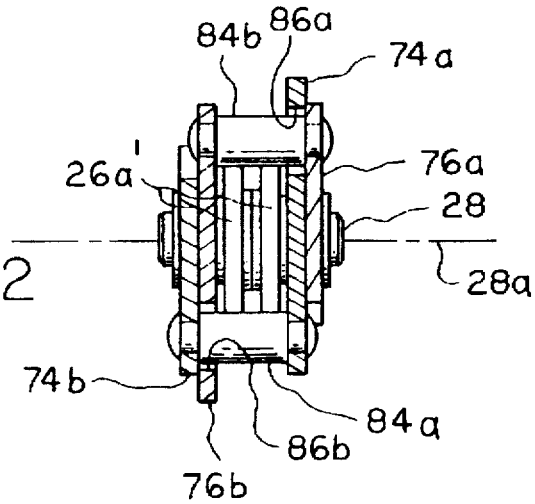
FIG. 12 is a sectional view taken generally along the line 12—12 in FIG. 9.

Clamping means 94 is shown in FIGS. 6 and 7 as being of conventional or known construction from the standpoint that it includes a housing 96 pivotally supported by pivot pin 38 and having brake rod 90 freely, slidably extending through first and second spaced ends 96*a* and 96*b* of such housing; a stack of conventional friction plates 98 having aligned through openings 100 for receiving the brake rod; a lever 102 having first and second end portions 102*a* and 102*b* and being supported adjacent the juncture of such end portions for pivotal movement about third axis 38*a* relative to both brake rod 90 and housing 96, as by pivot pin 38; and a compression spring 104 arranged intermediate housing first end 96*a* and friction plates 98 for biasing such friction plates into engagement with lever first end portion 102*a*. As will be apparent from viewing FIG. 7, lever first end portion 102*a* is formed with a through opening 106 sized to loosely receive brake rod 90, and lever second end portion 102*b* is formed with a through opening 108 for receiving one end of an operating cable 110 whose opposite end is coupled to a suitable manual operator 112 carried on the lower surface of surface 12. Clamping means 94 differs from known constructions in that it is pivotally supported on member 22 for swinging movement with such member about first pivot axis 24*a*.

By again viewing FIG. 7, it will be understood that lever 102 is shown in full line and broken line as assuming its brake release and brake operating positions, respectively. Spring 104 normally biases lever 102 to rotate clockwise about axis 38*a* into its brake operating position, wherein friction plates 98 are tilted relative to brake rod 90 sufficiently to frictionally clamp against the rod to oppose movement of surface 12 downwardly from its upper position of FIG. 3 into its lower position of FIG. 4, while permitting manually induced movement or lifting of such surface from its lower position into its upper position. When an operator actuates manual operator 112, cable 110 serves to pivot lever 102 counterclockwise from its brake operating position into its full line brake release position, wherein spring 104 is compressed and the degree of tilt of friction plates 98 is reduced sufficiently to free same from friction clamping engagement with brake rod 90, such as will permit free movement of surface 12 vertically in opposite directions between its upper and lower positions.

While the present invention has been described with reference to its use in providing for counterbalancing of a table top, it will be understood that such invention is not limited in use to tables. Rather, it is contemplated that mechanisms 18 and 20 have utility in controlling vertical movements of other surfaces, such as for example, desk tops and wall mounted shelves.

What is claimed is:

1. The combination comprising:

surface means;

base means;

means for supporting said surface means for movement between lower and upper positions relative to said base means;

a counterbalance mechanism for counterbalancing at least a part of the weight of said surface means during vertical movement between said positions and including a member coupled to said base means for movement about a first axis and said means for supporting said surface means, and spring means having a first end coupled to said base means and a second end coupled to said member by a rack and gear assembly for opposing movement of said surface means from said upper position towards said lower position, by varying a moment arm through which the spring acts about said first axis said rack and gear assembly having a rack having one edge and teeth extending along said one edge, said rack being supported by said member, first and second gears rotatable about each of two parallel axes respectively and having teeth arranged for engagement with each other and with said teeth of said rack, first and second link means having first ends connected with said first and second gears respectively for relative rotation about said two parallel axes and second ends connected to said spring for pivotal movement about a common axis disposed parallel to said two parallel axes, said two parallel axes and said common axis are on opposite sides of said rack, said spring tends to move said common axis transversely away from said rack and to bias said gears into releasably locking engagement with each other and with said rack to prevent movement of said further axis lengthwise of said rack, means for releasing said gears from locking engagement with each other and said rack to effect moment arm adjustment, and a brake mechanism for releasably opposing movement of said surface means from said upper position towards said lower position.

2. In a mechanism including column means for supporting a surface means for vertical movement relative to a base means between upper and lower positions, a counterbalance means for counterbalancing at least a part of the weight of said surface means, and brake means for releasably retaining said surface means in a selected position intermediate said upper and lower positions, the improvement comprising:

said counterbalance means includes a member having a first end supported by said base means for pivotal movement about a first axis and a second end coupled to said column means, whereby said surface means moves upwardly and downwardly incident to pivotal movement of said member in opposite directions about said first axis and spring means tending to bias said member for movement in one of said directions opposing downward movement of said surface means, said spring means has one end connected to said base means and a second end connected to said member by a rack and gear assembly for adjustably varying the moment arm through which said spring means acts about said first axis;

said assembly includes an elongated rack carried by said member and having an edge with teeth extending along said edge, first and second gears, and first and second link means having first ends connected to said first and second gears respectively for rotation about a pair of parallel gear axes disposed parallel to said first axis and second ends connected to said spring means for pivotal movement about a common axis disposed parallel to said pair of parallel gear axes, said pair of axes and said common axis being disposed on opposite side of said rack with said spring means tending to bias said gears into engagement with each other and said rack whereby to releasably lock said gears in an adjusted position lengthwise of said rack, and there is provided gear releasing means for releasing said gears for movement relative to said rack, said gear releasing means including a fitting on each of said gears shaped to individually, removably receive a manually operable tool adapted to drive a first of said gears for clockwise directed rotation away from a second of said gears to effect driven movement of said first gear along said rack in a direction away from said second gear or to drive said second gear for counterclockwise directed rotation away from said first gear to effect driven movement of said second gear along said rack in a direction away from said first gear to effect said moment arm adjustment; and said brake means includes a brake rod having a first end supported by said base means for pivotal movement about a second axis disposed parallel to said first axis and brake rod clamping means supported by said member for pivotal movement about a third axis disposed parallel to said first axis and supported by said brake rod for movement lengthwise of said brake rod, said clamping means normally clamping against said brake rod to prevent pivot movement of said member resulting in lowering of said surface and means to release said clamping means from clamping against said brake rod.

3. The improvement according to claim 2, wherein said rack has an opposite edge spaced from said edge thereof, and first and second link means carry first and second pins arranged to removably engage with said opposite edge.

4. The combination comprising:

surface means;

base means;

column means for supporting said surface means for movement between lower and upper positions relative to said base means;

a counterbalance mechanism for counterbalancing at least a part of the weight of said surface means during vertical movement between said positions and including a member coupled to said base means and said column means, and biasing means coupled to said base means and said member for opposing movement of said surface means from said upper position towards said lower position;

a brake mechanism coupled to said base means and said member for releasably opposing movement of said surface means from said upper position towards said lower position, said member has one end supported by said base means for pivotal movement about a first axis and an opposite end coupled to said column means and said brake mechanism, said brake mechanism includes a brake rod having a first end supported by said base means for pivotal movement about a second axis disposed parallel to said first axis and a brake rod clamping means releasably engageable with said brake rod for movement lengthwise of said brake rod, said clamping means being supported by said member for pivotal movement about a third axis disposed parallel to said first and second axes, and said clamping means includes a housing having first and second spaced ends, said brake rod freely extending through said first and second spaced ends; a stack of friction plates having aligned through openings for receiving said brake rod and being arranged within said housing; a lever having first and second end portions; a pivot pin for supporting said lever for pivotal movement about said third axis relative to said housing and said member, said first end portion being arranged for engagement with one end of said stack of plates, said second end portion being connected to a manual operator, and a spring arranged intermediate said first end of said housing and an opposite end of said stack of plates for biasing said stack of plates into engagement with said first end portion, said lever having brake operating and brake release positions, said spring tending to maintain said lever in said brake operating position, wherein said stack of plates is disposed in frictional clamping engagement with said brake rod to oppose movement of said surface means from said upper position towards said lower position, while permitting manually induced movement of said surface means from said lower position towards said upper position, and said lever when in said brake release position releasing said stack of plates from frictional clamping engagement with said brake rod against the bias of said spring to permit free movement of said surface means vertically between said upper and lower positions.

5. The combination comprising:

surface means;

base means;

column means for supporting said surface means for movement between lower and upper positions relative to said base means;

a counterbalance mechanism for counterbalancing at least a part of the weight of said surface means during vertical movement between said positions and including a member coupled to said base means and said column means, and biasing means coupled to said base means and said member for opposing movement of said surface means from said upper position towards said lower position; and a brake mechanism coupled to said base means and said member for releasably opposing movement of said surface means from said upper position towards said lower position, said member has a first end supported by said base means for pivotal movement about a first axis, a second end coupled to said column means and brake mechanism, said biasing means is a spring having one end connected to said base means and a second end connected to said member by a rack and gear assembly for adjustably varying the moment arm through which said spring acts about said first axis, and said rack and gear assembly comprises:

a rack having one edge and teeth extending along said one edge, said rack being supported by said member;

first and second gears rotatable about parallel gear axes and having teeth arranged for engagement with each other and with said teeth of said rack;

first and second link means having first ends connected with said first and second gears respectively for relative rotation about said gear axes and second ends connected to said spring for pivotal movement about a common axis disposed parallel to said gear axes, and said gear axes and said common axis on opposite sides of said rack;

said spring tends to move said common axis transversely away from said rack, thereby to bias said gears into releasably locking engagement with each other and with said rack to prevent movement of said common axis lengthwise of said rack; and means for releasing said gears from locking engagement with each other and said rack for moment arm adjustment.

6. The combination according to claim 5, wherein said means for releasing said gears includes a fitting on each of said gears shaped to individually, removably receive a manually operable tool adapted to drive a first of said gears for clockwise directed rotation away from a second of said gears to effect driven movement of said first gear along said rack in a direction away from said second gear or to drive said second gear for counterclockwise directed rotation away from said first gear to effect driven movement of said second gear along said rack in a direction away from said first gear.

7. The combination according to claim 6, wherein said rack has an opposite edge spaced from said one edge, and said first and second link means carry first and second pins arranged to removably engage with said opposite edge.

8. The combination according to claim 6, wherein said brake mechanism includes a brake rod having a first end supported by said base means for pivotal movement about a second axis disposed parallel to said first axis and a brake clamping means for releasably engaging with said brake rod at selected positions lengthwise thereof and supported by said member for pivotal movement about a third axis disposed parallel to said first, second and further axes.

9. The combination according to claim 8, wherein said brake clamping means includes a housing having said brake rod freely extending through first and second spaced ends thereof; a stack of friction plates having aligned through openings for receiving said brake rod and being arranged within said housing; a lever having first and second end portions; a pivot pin for supporting said lever for pivotal movement about said third axis relative to said housing and said member, said first end portion being arranged for engagement with said stack of plates, said second end portion being connected to a manual operator, and a clamping spring arranged intermediate said first end of said housing and said stack of plates for biasing said stack into engagement with said first end portion, said lever having brake operating and brake release positions, said clamping spring tending to maintain said lever in said brake operating position, wherein said stack of plates is disposed in frictional clamping engagement with said brake rod to oppose movement of said surface means from said upper position towards said lower position, while permitting manually induced movement of said surface means from said lower position towards said upper position, and said lever when in said brake release position releasing said stack of plates from frictional clamping engagement with said brake rod against the bias of said clamping spring to permit free movement of said surface vertically between said upper and lower positions.

10. The combination according to claim 6, wherein said brake mechanism includes a brake rod having one end pivotally supported by said base means, brake rod clamping means pivotally supported by said member and supported by said brake rod for movement lengthwise thereof, said brake rod clamping means normally clampingly engaging with said brake rod to prevent movement of said clamping means in one direction relative to said brake rod, while permitting sliding movement of said clamping means in an opposite direction relative thereto, and manually operable means for selectively releasing said clamping means to permit movement of said clamping means in said one direction.

* * * * *

UNITED STATES PATENT AND TRADEMARK OFFICE

CERTIFICATE OF CORRECTION

PATENT NO. : 5,797,331

DATED : August 25, 1998

INVENTOR(S) : Richard L. Watt

It is certified that error appears in the above-identified patent and that said Letters Patent is hereby corrected as shown below:

In Claim 1, Column 2, line 14, change "further" to "common"
In Claim 2, line 49, insert "parallel gear" before "axes"
In Claim 2, line 50, change "side" to "sides"

Signed and Sealed this

Twenty-second Day of June, 1999

*Attest:*

*Attesting Officer*

Q. TODD DICKINSON

*Acting Commissioner of Patents and Trademarks*